US008579613B2

(12) United States Patent
Kobayashi et al.

(10) Patent No.: US 8,579,613 B2
(45) Date of Patent: Nov. 12, 2013

(54) VANE PUMP AND VAPOR LEAKAGE CHECK SYSTEM HAVING THE SAME

(75) Inventors: Mitsuyuki Kobayashi, Gamagori (JP); Tomohiro Itoh, Takahama (JP)

(73) Assignee: Denso Corporation, Kariya (JP)

( * ) Notice: Subject to any disclaimer, the term of this patent is extended or adjusted under 35 U.S.C. 154(b) by 225 days.

(21) Appl. No.: 13/160,599

(22) Filed: Jun. 15, 2011

(65) Prior Publication Data

US 2011/0311385 A1 Dec. 22, 2011

(30) Foreign Application Priority Data

Jun. 21, 2010 (JP) ..... 2010-140398

(51) Int. Cl.
*F03C 2/00* (2006.01)
*F03C 4/00* (2006.01)
*F04C 2/00* (2006.01)

(52) U.S. Cl.
USPC ..... 418/15; 418/133; 418/131; 418/259; 418/268; 73/118.01

(58) Field of Classification Search
USPC ..... 418/15, 256, 266–268, 133–135; 73/118.1
See application file for complete search history.

(56) References Cited

U.S. PATENT DOCUMENTS

2009/0148329 A1 6/2009 Kobayashi et al.

FOREIGN PATENT DOCUMENTS

JP P2005-330895 A 12/2005
JP P2008-151114 A 7/2008

OTHER PUBLICATIONS

Japanese Official Action dated Dec. 14, 2012 issued in corresponding Japanese Application No. 2010-140398, with English translation.
Japanese Office Action dated Apr. 17, 2012, issued in corresponding Japanese Application No. 2010-140398, with English translation.

*Primary Examiner* — Theresa Trieu
(74) *Attorney, Agent, or Firm* — Nixon & Vanderhye P.C.

(57) ABSTRACT

A vane pump includes a housing defining a pump chamber; a rotor rotatably arranged in the pump chamber; and a motor to rotate the rotor. An imaginary plane is defined to bisect the pump chamber in an axis direction. The housing has a first inlet port and a second inlet port located symmetrical with each other with respect to the imaginary plane, and the housing has a first outlet port and a second outlet port located symmetrical with each other with respect to the imaginary plane.

8 Claims, 7 Drawing Sheets

VANE PUMP AND VAPOR LEAKAGE CHECK SYSTEM HAVING THE SAME

CROSS REFERENCE TO RELATED APPLICATION

This application is based on Japanese Patent Application No. 2010-140398 filed on Jun. 21, 2010, the disclosure of which is incorporated herein by reference in its entirety.

BACKGROUND OF THE INVENTION

1. Field of the Invention

The present invention relates to a vane pump and a vapor leakage check system having the vane pump.

2. Description of Related Art

JP-A-2009-138602 describes a vane pump having a rotor and a motor. When the rotor is rotated by the motor, fluid is compressed, and the compressed fluid is discharged from the vane pump. The vane pump is used for decompressing or compressing an inside of a fuel tank in an vapor leakage check system that checks a leakage of vapor fuel from the fuel tank.

The rotor has an approximately cylindrical column shape, and is arranged in a pump chamber. The pump chamber has an inlet port connected to an orifice and a canister, and an outlet port connected to outside atmospheric air. The inlet port and the outlet port are located on the same end of the pump chamber in an axis direction.

However, a pressure difference is generated between the end of the pump chamber having the inlet port and the outlet port and the other end of the pump chamber in the axis direction. In this case, a pressure gradient is generated in the axis direction, thereby affecting a posture of the rotor. If the pressure gradient causes an unstable rotation of the rotor, a pumping property of the vane pump may become unstable.

SUMMARY OF THE INVENTION

In view of the foregoing and other problems, it is an object of the present invention to provide a vane pump and a vapor leakage check system having the vane pump.

According to a first example of the present invention, a vane pump includes a housing, a rotor, and a motor. The housing includes a cylindrical part, a first board closing an end of the cylindrical part, a second board closing the other end of the cylindrical part. A pump chamber is defined among the cylindrical part, the first board and the second board. The rotor is rotatably arranged in the pump chamber, and has a center hole passing through the rotor in an axis direction at an approximately center position. The rotor has a plurality of vanes slidable on an inner wall of the housing. The rotor has an approximately column shape. The motor has a shaft fitted into the center hole of the rotor, and rotates the rotor by rotating the shaft. An imaginary plane is defined to bisect the pump chamber in the axis direction. The housing has a first inlet port and a second inlet port located symmetrical with each other with respect to the imaginary plane. The housing has a first outlet port and a second outlet port located symmetrical with each other with respect to the imaginary plane.

According to a second example of the present invention, a vapor leakage check system to detect a leakage of fuel vapor from a fuel tank includes the vane pump, a pressure sensor to detect a pressure in the fuel tank, and an electronic control unit. The electronic control unit detects the leakage of fuel vapor by comparing the pressure detected by the pressure sensor with a threshold pressure when an inside of the fuel tank is decompressed or compressed by driving the vane pump.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENT (First Embodiment)

Figure 1:
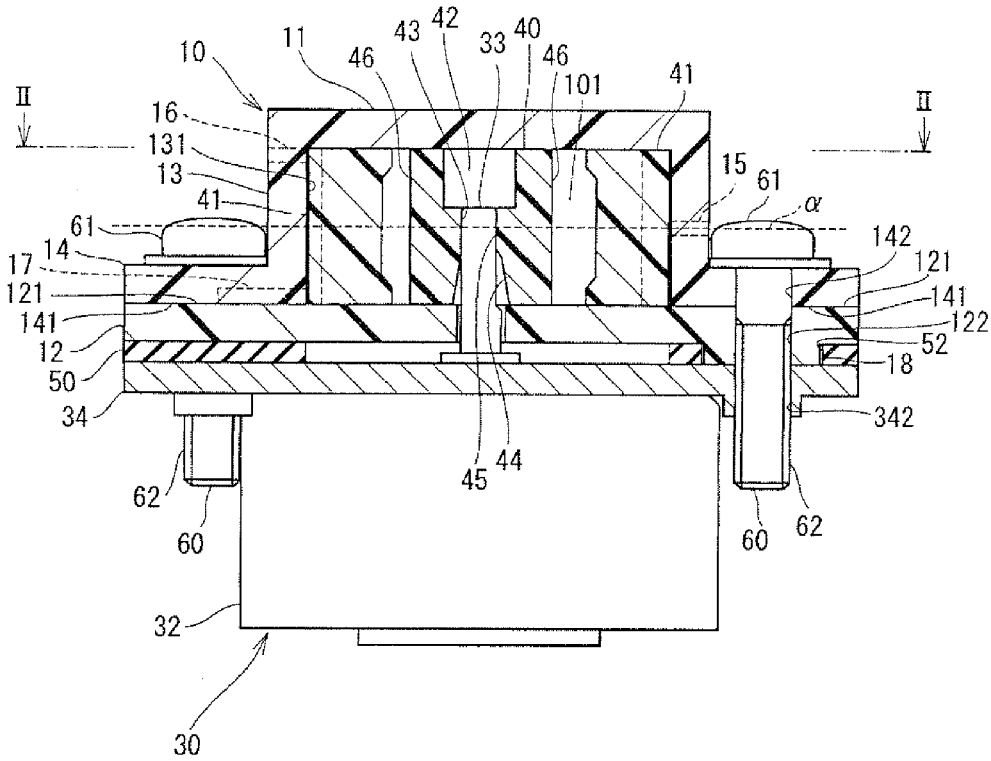
FIG. 1 is a cross-sectional view illustrating a vane pump according to a first embodiment.
Figure 5:
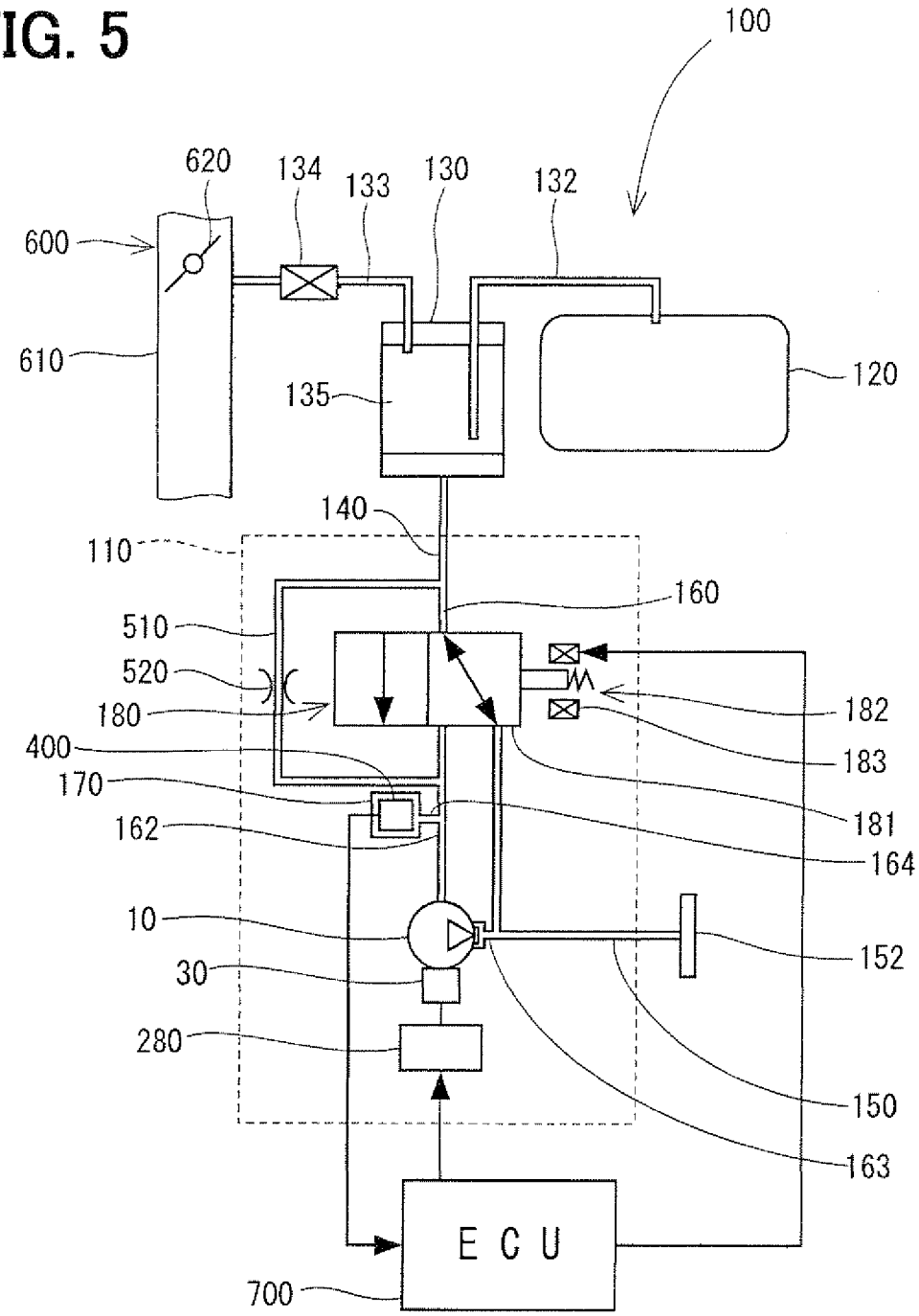
FIG. 5 is a vapor leakage check system having the vane pump of the first embodiment.

A vane pump 1 of FIG. 1 is used in a vapor leakage check system 100 of FIG. 5, for example. The check system 100 checks a leakage of fuel vapor from a fuel tank 120. The vane pump 1 draws and compresses fluid, and the compressed fluid is discharged from the vane pump 1. The fluid may be gas such as air or liquid such as water.

As shown in FIG. 1, the vane pump 1 includes a housing 10, a rotor 40, and a motor 30, The housing 10 is made of resin material, for example, and has a first board 11, a second board 12, and a cylindrical part 13. The cylindrical part 13 has an approximately cylindrical shape, and an inner circumference wall 131 of the cylindrical part 13 has an approximately cylindrical surface. An open end of the cylindrical part 13 in an axis direction is closed by the first board 11. The first board 11 and the cylindrical part 13 are integrated with each other, for example, so as to have a based cylindrical shape. The other end of the cylindrical part 13 in the axis direction has a flange 14 extending outward in a radial direction. The flange 14 has a plane part 141 constructed by a flat face of the flange 14 located opposite from the first board 11.

A face of the second board 12 opposing to the first board 11 defines a plane part 121. The plane part 121 of the second board 12 is joined to the plane part 141 of the flange 14. The second board 12 covers the other open end of the cylindrical part 13 in the axis direction. A pump chamber 101 is defined inside of the cylindrical part 13, and is surrounded by the first board 11, the cylindrical part 13 and the second board 12. That is, an opening part of the pump chamber 101 defined in the housing 10 is closed by the second board 12.

Figure 2:
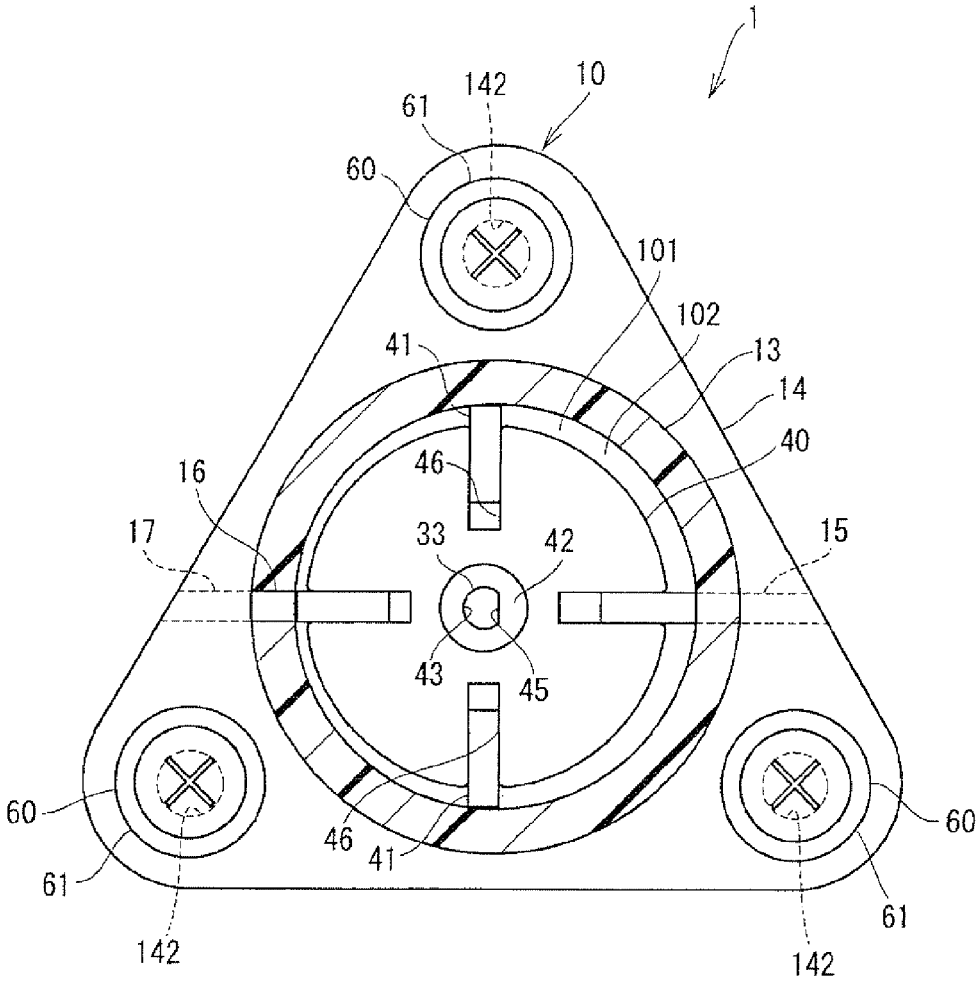
FIG. 2 is a cross-sectional view taken along line II-II of FIG. 1.

The pump chamber 101 accommodates the rotor 40, and the rotor 40 is rotatable in the pump chamber 101. As shown in FIG. 2, a space 102 is defined between the cylindrical part 13 and the rotor 40, and is surrounded by the first board 11 and the second board 12 in the axis direction. The rotor 40 is located eccentric to an axis of the cylindrical part 13, so that a volume of the space 102 is varied in a circumference direction of the cylindrical part 13.

The space 102 is connected to an inlet port 15, a first outlet port 16, and a second outlet port 17 of the housing 10. The port 15, 16, 17 extends outward in the radial direction from the space 102. As shown in FIG. 1, the inlet port 15 is defined on an imaginary plane α that bisects the pump chamber 101 in the axis direction. The inlet port 15 is defined in a manner that a first inlet port and a second inlet port are overlap with each other on the imaginary plane α, so that the inlet port 15 corresponds to the first inlet port and the second inlet port.

The first outlet port 16 and the second outlet port 17 are located to be symmetrical with each other with respect to the imaginary plane α. The first outlet port 16 is defined on an upper end portion of the cylindrical part 13 in the axis direction, and the second outlet port 17 is defined on a lower end portion of the cylindrical part 13 in the axis direction. The first outlet port 16 is defined to contact the first board 11, and the second outlet port 17 is defined to contact the second board 12. As shown in FIG. 2, the inlet port 15, the outlet port 16, and the outlet port 17 are located on the same plane including the axis of the pump chamber 101.

The rotor 40 has an approximately column shape, and is made of resin material, for example. The rotor 40 has a recess 42 and a main hole 43 at a central position. As shown in FIG. 1, the recess 42 is recessed from an upper end face of the rotor 40 opposing to the first board 11 in the axis direction as a measure for a shrinkage generated in a producing process of the rotor 40. The main hole 43 passes through the rotor 40 in a thickness direction of the board 11, 12, and connects the recess 42 to the second board 12. The main hole 43 has a tapered part 44 in which a diameter of the main hole 43 is gradually reduced in the axis direction from a lower end of the rotor 40 opposing to the second board 12 to a middle position. Moreover, the main hole 43 has a non-circular part 45 having a non-circular cross-section at a position between the tapered part 44 and the recess 42 in the axis direction.

A shaft 33 of the motor 30 is arranged to extend through the main hole 43 of the rotor 40. The shaft 33 is fitted with the non-circular part 45 by being guided by the tapered part 44, when the shaft 33 is inserted into the main hole 43 of the rotor 40. A cross-sectional shape of the shaft 33 is approximately the same as that of the non-circular part 45. A cross-sectional area of the non-circular part 45 is larger than that of an end portion of the shaft 33. That is, a clearance is defined between an inner wall of the rotor 40 corresponding to the non-circular part 45 and an outer wall of the shaft 33. The shaft 33 is loosely fitted to the rotor 40. When the shaft 33 is rotated, the rotor 40 is rotated together with the shaft 33.

As shown in FIG. 2, the rotor 40 has four vane accommodation slots 46 recessed inward in the radial direction from an outer circumference wall of the rotor 40. As shown in FIG. 1, the slot 46 extends in the axis direction between the lower end face of the rotor 40 opposing to the second board 12 and the upper end face of the rotor 40 opposing to the first board 11. As shown in FIG. 2, the four slots 46 are located in the circumference direction of the rotor 40 with a regular interval. Vanes 41 are respectively arranged in the four slots 46 of the rotor 40. The rotor 40 and the inner circumference wall 131 of the cylindrical part 13 are located eccentric with each other, so that a distance between the rotor 40 and the inner circumference wall 131 of the cylindrical part 13 is changed while the rotor 40 is rotated.

While the rotor 40 is rotated, the vane 41 moves outward in the radial direction, and touches the inner circumference wall 131, due to a centrifugal force. As the distance between the rotor 40 and the inner circumference wall 131 of the cylindrical part 13 becomes smaller, the vane 41 is pushed into the slot 46 inward in the radial direction. That is, the vane 41 reciprocates in the radial direction inside of the slot 46 while the rotor 40 is rotated. At this time, an outer end of the vane 41 contacts the inner circumference wall 131 of the cylindrical part 13.

The rotor 40 is arranged in the pump chamber 101, and is driven by the motor 30. The second board 12 and an elastic sheet 50 are arranged between the motor 30 and the rotor 40 in the axis direction. The motor 30 may be a direct-current electric motor or an alternating-current electric motor. The motor 30 has a cover 32 accommodating a stator (not shown), the shaft 33 rotating with the rotor 40, and a mount part 34. The second board 12 and the elastic sheet 50 are mounted to the mount part 34 of the motor 30. The mount part 34 is made of metal material, for example, and has a mount hole 342. A female thread is defined on an inner wall of the mount hole 342.

The flange 14 of the cylindrical part 13 has a through hole 142 at a position corresponding to the mount hole 342 of the mount part 34. As shown in FIG. 2, three through holes 142 are defined in the flange 14.

As shown in FIG. 1, the second board 12 has a projection 18 projected toward the motor 30 at a position corresponding to the through hole 142 of the flange 14. An approximately center position of the projection 18 has a through hole 122 passing through the second board 12 in the thickness direction. A position of the through hole 122 corresponds to that of the through hole 142.

The elastic sheet 50 is arranged between the second board 12 and the mount part 34 of the motor 30. The elastic sheet 50 has elasticity and a large damping coefficient. For example, the elastic sheet 50 may be made of board-shaped rubber. A through hole 52 is defined in the elastic sheet 50 at a position corresponding to the projection 18 of the second board 12. An inner diameter of the through hole 52 is approximately equal to or slightly larger than an outer diameter of the projection 18.

As shown in FIG. 1, a screw 60 has an axis part 62 and a head 61 fixed to an end of the axis part 62. An external-thread is defined on the axis part 62. The screw 60 passes through the hole 142 of the flange 14, the hole 122 of the second board 12, the hole 52 of the elastic sheet 50, and the mount hole 342 of the motor 30, and is mounted to the mount part 34 of the motor 30. The flange 14, the second board 12, and the elastic sheet 50 are interposed between the head 61 of the screw 60 and the mount part 34 of the motor 30, and are tightened to the mount part 34. At this time, axial tension works between the head 61 of the screw 60 and the mount part 34. Therefore, the elastic sheet 50 is compressed between the second board 12 and the mount part 34 in the axis direction. A reaction force is generated from the elastic sheet 50, so that the second board 12 receives a face pressure from the elastic sheet 50 toward the flange 14. As a result, the plane part 121 of the second board 12 tightly contacts the plane part 141 of the flange 14. Therefore, air-tightness or liquid-tightness of the pump chamber 101 can be kept.

The vane pump 1 is arranged in a manner that the axis direction of the cylindrical part 13 is coincident with a gravity direction. Therefore, an end of the cylindrical part 13 in the axis direction is located on a lower side in the gravity direction. The outlet port 17 contacting the second board 12 is located on the lower side in the gravity direction, and the outlet port 16 contacting the first board 11 is located on an upper side in the gravity direction.

Operation and advantage of the vane pump 10 are explained with reference to FIGS. 3A and 3B.

The rotor 40 connected with the shaft 33 is rotated by the motor 30. While the vane 41 is rotated with the rotor 40, the vane 41 contacts the inner circumference wall 131 of the cylindrical part 13. The volume of the space 102 is reduced in a rotation direction defined from the inlet port 15 to the outlet port 16, 17. Therefore, when the vane 41 is rotated with the rotor 40, fluid flowing through the space 102 from the inlet port 15 to the outlet port 16, 17 is pressurized. That is, fluid drawn through the inlet port 15 is pressurized inside the space 102 by the vane 41 rotated with the rotor 40, and the pressurized fluid is discharged out of the vane pump 10 from the outlet port 16, 17. Fluid is continuously pressurized by the rotation of the rotor 40.

Figure 3A:
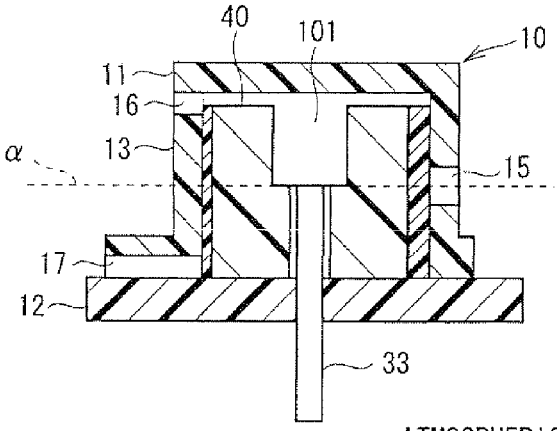
FIG. 3A is a schematic view illustrating port positions of a housing of the vane pump with respect to an imaginary plane.

As shown in FIG. 3A, fluid having a negative pressure is drawn from the inlet port 15, and the drawn fluid is discharged to atmospheric air through the outlet port 16, 17. The inlet port 15 is defined on the imaginary plane α dividing the pump chamber 101 into two equal parts in the axis direction. The first outlet port 16 and the second outlet port 17 are located symmetrical with each other with respect to the imaginary plane α.

Figure 3B:
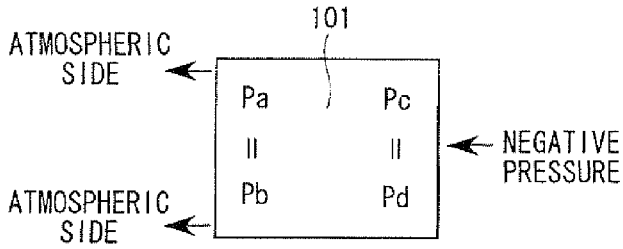
FIG. 3B is a view illustrating characteristics of the vane pump.

As shown in FIG. 3B corresponding to FIG. 3A, an upper left area of the pump chamber 101 is defined to have a pressure Pa, a lower left area of the pump chamber 101 is defined to have a pressure Pb, an upper right area of the pump chamber 101 is defined to have a pressure Pc, and a lower right area of the pump chamber 101 is defined to have a pressure Pd. The pressure Pa is equal to the pressure Pb (Pa=Pb), and the pressure Pc is equal to the pressure Pd (Pc=Pd), due to the symmetrical position relationship. Therefore, a pressure difference is not generated between the upper end of the pump chamber 101 and the lower end of the pump chamber 101 in the axis direction. Thus, a posture of the rotor 40 can be prevented from being affected, so that the pumping property can be maintained stable.

The vane pump 1 is positioned in a manner that the axis direction of the cylindrical part 13 is coincident with the gravity direction. The first outlet port 16 is defined to contact the first board 11, and the second outlet port 17 is defined to contact the second board 12. Moreover, the second outlet port 17 is located on the lower end of the cylindrical part 13 in the gravity direction. Therefore, if wear powder is generated when the rotor 40 slides on the first board 11 and the second board 12, or if wear powder is generated when the vane 41 slides on the cylindrical part 13, the wear powder can be easily discharged out of the pump chamber 101. Further, the number of components producing the vane pump 1 can be reduced because the first board 11 and the cylindrical part 13 are integrated with each other, so that the producing cost of the vane pump 1 can be reduced.

Figure 4A:
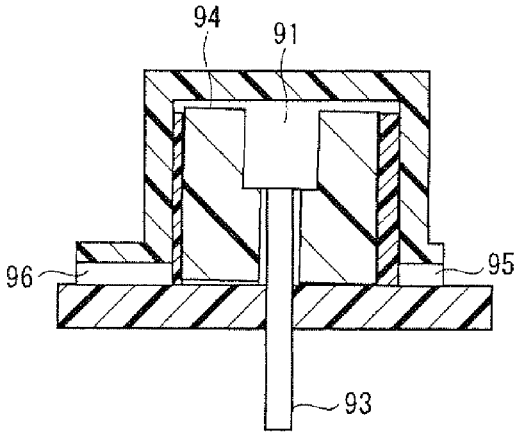
FIG. 4A is a schematic view illustrating port positions of a housing of a vane pump of a comparison example.

A comparison example is described with reference to FIGS. 4A and 4B. As shown in FIG. 4A, a vane pump of the comparison example has an inlet port 95 and an outlet port 96, both of which are located on a lower end of a pump chamber 91 in the axis direction.

In the comparison example, while a rotor 94 is rotated, fluid having a negative pressure is drawn through the inlet port 95 and the drawn fluid is discharged to atmospheric air through the outlet port 96. A pressure of fluid in the pump chamber 91 located close to the outlet port 96 in the axis direction is higher than that located far from the outlet port 96. A pressure of fluid in the pump chamber 91 located far from the inlet port 95 in the axis direction is higher than that located close to the inlet port 95.

Figure 4B:
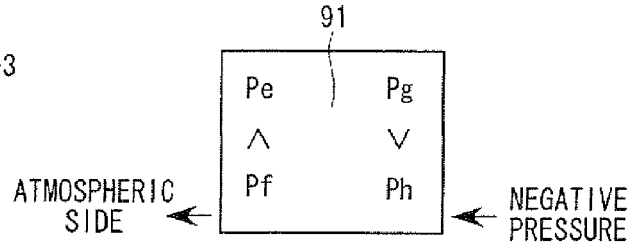
FIG. 4B is a view illustrating characteristics of the comparison example.

As shown in FIG. 4B, in the comparison example, an upper left area of the pump chamber 91 is defined to have a pressure Pe, a lower left area of the pump chamber 91 is defined to have a pressure Pf, an upper right area of the pump chamber 91 is defined to have a pressure Pg, and a lower right area of the pump chamber 91 is defined to have a pressure Ph. The pressure Pf is higher than the pressure Pe (Pf>Pe), and the pressure Pg is higher than the pressure Ph (Pg>Ph). That is, in the comparison example, a pressure difference is generated between the upper end of the pump chamber 91 and the lower end of the pump chamber 91 in the axis direction. Therefore, the rotor 94 may be inclined with respect to a shaft 93, so that a posture of the rotor 94 may be affected by the pressure difference.

In contrast, according to the first embodiment, as shown in FIG. 3A, the inlet port 15 is located on the imaginary plane α bisecting the pump chamber 101 in the axis direction. Therefore, fluid drawn from the inlet port 15 flows on both sides of the imaginary plane α in the axis direction symmetrically. Thus, the pressures Pc, Pd of the upper right area and the lower right area opposing to the inlet port 15 are equal with each other (Pc=Pd). Moreover, the first outlet port 16 and the second outlet port 17 are located symmetrical to each other with respect to the imaginary plane α, so that fluid is discharged to atmospheric air through the outlet ports 16, 17 on both sides symmetrically with respect to the imaginary plane α. Thus, the pressure Pa of the upper left area opposing to the outlet port 16 and the pressure Pb of the lower left area opposing to the outlet port 17 are equal with each other (Pc=Pd). Accordingly, a pressure difference can be prevented from being generated between the upper end and the lower end in the axis direction of the pump chamber 101, so that the posture of the rotor 94 can be restricted from being affected.

A vapor leakage check system 100 having the vane pump 10 will be described with reference to FIG. 5. The vane pump 10 is used for decompressing, for example, an inside of the fuel tank 120.

The check system 100 includes a check module 110, the fuel tank 120, a canister 130, an air intake device 600, and an electronic control unit (ECU) 700. The check module 110 includes the vane pump 1 having the housing 10 and the motor 30, a switching valve 180, and a pressure sensor 400. The switching valve 180 and the canister 130 are connected with each other by a canister passage 140. An atmospheric passage 150 has an open end 152 opposite from the check module 110. The canister passage 140 and the atmospheric passage 150 are connected with each other by a connection passage 160. The connection passage 160 and the inlet port 15 of the vane pump 10 are connected with each other by a pump passage 162. The outlet port 16, 17 of the vane pump 10 is connected to the atmospheric passage 150 by a discharge passage 163. A pressure introducing passage 164 is branched from the pump passage 162, and connects the pump passage 162 to a sensor chamber 170. The pressure sensor 400 is arranged in the sensor chamber 170. A pressure of the sensor chamber 170 is approximately the same as that of the pressure introducing passage 164 and the pump passage 162.

An orifice passage 510 is branched from the canister passage 140, and connects the canister passage 140 to the pump passage 162, An orifice 520 is arranged in the orifice passage 510. The orifice 520 allows a predetermined amount of air leakage containing vapor fuel from the fuel tank 120.

The switching valve 180 has a main part 181 and an actuator 182 to drive the main part 181. The actuator 182 has a coil 183 connected to the ECU 700. The ECU 700 intermittently allows electricity supply for the coil 183. While electricity is not supplied to the coil 183, the connection passage 160 is disconnected from the pump passage 162, and the canister passage 140 and the atmospheric passage 150 communicate with each other via the connection passage 160. In contrast, while electricity is supplied to the coil 183, the canister passage 140 and the pump passage 162 communicate with each other, and the canister passage 140 is disconnected from the atmospheric passage 150. The orifice passage 510 and the pump passage 162 always communicate with each other.

The canister 130 includes adsorbent 135 such as activated carbon. The canister 130 is disposed between the check module 110 and the fuel tank 120, and adsorbs vapor fuel generated in the fuel tank 120. The canister 130 is connected to the check module 110 by the canister passage 140, and the canister 130 is connected to the fuel tank 120 by a tank passage 132. A purging passage 133 communicates with an inlet pipe 610 of the air intake device 600, and is connected to the canister 130. A throttle 620 is arranged in the inlet pipe 610, Vapor fuel generated in the fuel tank 120 passes through a tank passage 132, and is adsorbed by the adsorbent 135. A purge valve 134 is disposed in the purging passage 133 which connects the canister 130 to the inlet pipe 610 of the air intake device 600. The purge valve 134 opens or closes the purging passage 133 based on a signal output from the ECU 700.

The pressure sensor 400 detects a pressure of the sensor chamber 170, and outputs a signal into the ECU 700 based on the detected pressure. The ECU 700 is a microcomputer having CPU, ROM and RAM (not shown), for example. Signals output from various sensors such as the pressure sensor 400 are input into the ECU 700. The ECU 700 controls the check system 100 in accordance with a predetermined control program recorded in the ROM based on the signals.

Electricity is not supplied to the coil 183 while the engine is active and during a predetermined period after the engine is stopped. In these periods, the canister passage 140 and the atmospheric passage 150 communicate with each other through the connection passage 160. Therefore, vapor fuel is removed by the canister 130 while air containing vapor fuel generated from the fuel tank 120 passes through the canister 130, and the cleaned air is emitted to atmospheric air from the open end 152 of the atmospheric passage 150.

If the predetermined period passes after the engine is stopped, a check of air leakage containing vapor fuel generated from the fuel tank 120 is started. An atmospheric pressure is detected by the pressure sensor 400 so as to correct an error generated by an altitude of a place at which the vehicle is parked. While electricity is not supplied to the coil 183, the atmospheric passage 150 and the pump passage 162 communicate with each other via the orifice passage 510. Because the sensor chamber 170 communicates with the pump passage 162 via the pressure introducing passage 164, a pressure of the sensor chamber 170 is approximately the same as an atmospheric pressure. Therefore, the atmospheric pressure is detected by the pressure sensor 400 arranged in the sensor chamber 170.

When the detection of the atmospheric pressure is finished, the altitude of the place at which the vehicle is parked is calculated from the detected pressure. The ECU 700 corrects various kinds of parameters based on the calculated altitude. Then, the ECU 700 supplies electricity to the coil 183 of the switching valve 180. When electricity is started to be supplied to the coil 183, the switching valve 180 moves rightward in FIG. 5. Thereby, the switching valve 180 connects the canister passage 140 to the pump passage 162, and disconnects the canister passage 140 from the atmospheric passage 150. Therefore, the sensor chamber 170 connected to the pump passage 162 communicates with the fuel tank 120 via the canister 130. When vapor fuel is occurred inside the fuel tank 120, an inside pressure of the fuel tank 120 is higher than the atmospheric pressure around the vehicle.

If a pressure increasing is detected when vapor fuel is generated in the fuel tank 120, the ECU 700 stops the electricity supply to the coil 183 of the switching valve 180. If the electricity supply to the coil 183 is stopped, the pump passage 162 communicates with the canister passage 140 and the atmospheric passage 150 via the orifice passage 520. Moreover, the canister passage 140 and the atmospheric passage 150 communicate with each other via the connection passage 160.

When electricity is supplied to the motor 30, the vane pump 10 is driven so as to decompress the pump passage 162. Therefore, air flowing from the atmospheric passage 150 enters the pump passage 162 via the orifice passage 510. A flow of the air entering the pump passage 162 is narrowed by the orifice 520, so that the pressure of the pump passage 162 is lowered. The pressure of the pump passage 162 becomes constant after being lowered to a predetermined pressure corresponding to an opening area of the orifice 520. At this time, the detected pressure of the pump passage 162 is recorded as a basis pressure. When the detection of the basis pressure is finished, the electricity supply to the motor 30 is stopped.

When the basis pressure is detected, electricity supply to the coil 183 of the switching valve 180 is started again. Thereby, the atmospheric passage 150 is disconnected from the canister passage 140, and the canister passage 140 and the pump passage 162 communicate with each other. Therefore, the fuel tank 120 communicates with the pump passage 162, so that the pressure of the pump passage 162 becomes equal to that of the fuel tank 120. Then, the vane pump 10 is activated by supplying electricity to the motor 30. The inside of the fuel tank 120 is decompressed by the vane pump 10. At this time, the pump passage 162 communicates with the fuel tank 120. Therefore, the pressure detected by the pressure sensor 400 is approximately the same as the inside pressure of the fuel tank 120, because the sensor chamber 170 communicates with the pump passage 162.

While the operation of the vane pump 10 is continued, if the inside pressure of the fuel tank 120 becomes lower than the basis pressure, the air leakage is determined to be equal to or lower than a threshold. That is, when the inside pressure of the fuel tank 120 is lower than the basis pressure, air does not enter the fuel tank 120 from outside, or the amount of air entering the fuel tank 120 is equal to or smaller than a flow rate of the orifice 520. Therefore, the air-tightness of the fuel tank 120 is determined to be fully secured.

In contrast, if the inside pressure of the fuel tank 120 is not lowered to the basis pressure, the air leakage is determined to be higher than the threshold.

That is, air enters the fuel tank 120 from outside because the inside pressure of the fuel tank 120 is lowered. Therefore, the air-tightness of the fuel tank 120 is determined not to be secured.

When the check of the air leakage is completed, electricity supply to the motor 30 and the switching valve 180 is stopped. When the ECU 700 detects that the pressure of the pump passage 162 is recovered to the atmospheric pressure, the ECU 700 stops the operation of the pressure sensor 400 and ends the check process.

Because the pumping property of the vane pump 10 is maintained as stable, the vane pump 10 can be suitably used for lowering the inside pressure of the fuel tank 120 by applying the vane pump 10 into the check system 100. Therefore, the check can be stably performed by the check system 100.

(Second Embodiment)

A second embodiment will be described with reference to FIGS. 6 and 7. In a second embodiment, a vane pump 2 includes a housing 20 that is different from the housing 10 of the vane pump 1 of the first embodiment. Other construction of the vane pump 2 is similar to that of the vane pump 1 of the first embodiment, so that detailed description of the similar part is omitted.

The vane pump 2 includes the housing 20, the rotor 40 and the motor 30. The housing 20 has a first board 21, a second board 12, and a cylindrical part 23. The cylindrical part 23 has an approximately cylindrical shape, and an inner circumference wall 231 of the cylindrical part 23 has an approximately cylindrical surface. An open end of the cylindrical part 23 in an axis direction is closed by the first board 21, and the other open end of the cylindrical part 23 is closed by the second board 12. The housing 20 is constructed by stacking the second board 12, the cylindrical part 23 and the first board 21 in this order, for example, and the boards 12, 21 and the cylindrical part 23 are independent from each other.

Figure 6:
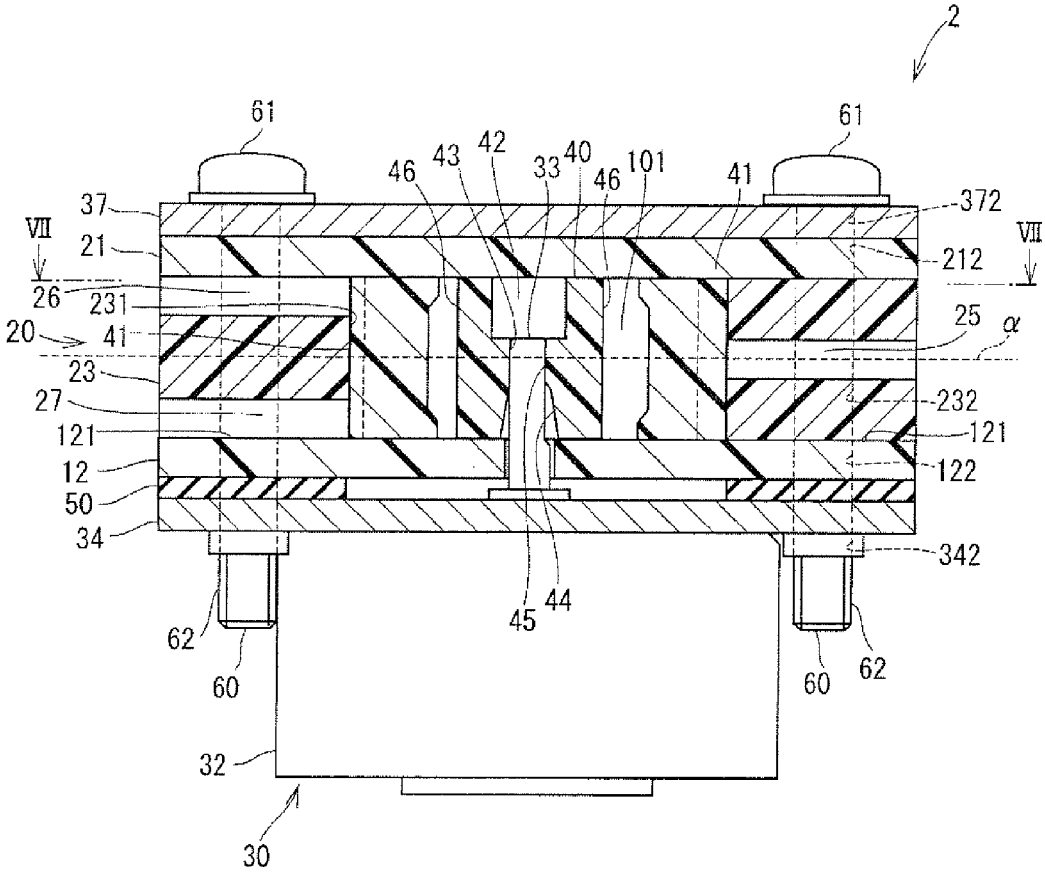
FIG. 6 is a cross-sectional view illustrating a vane pump according to a second embodiment.
Figure 7:
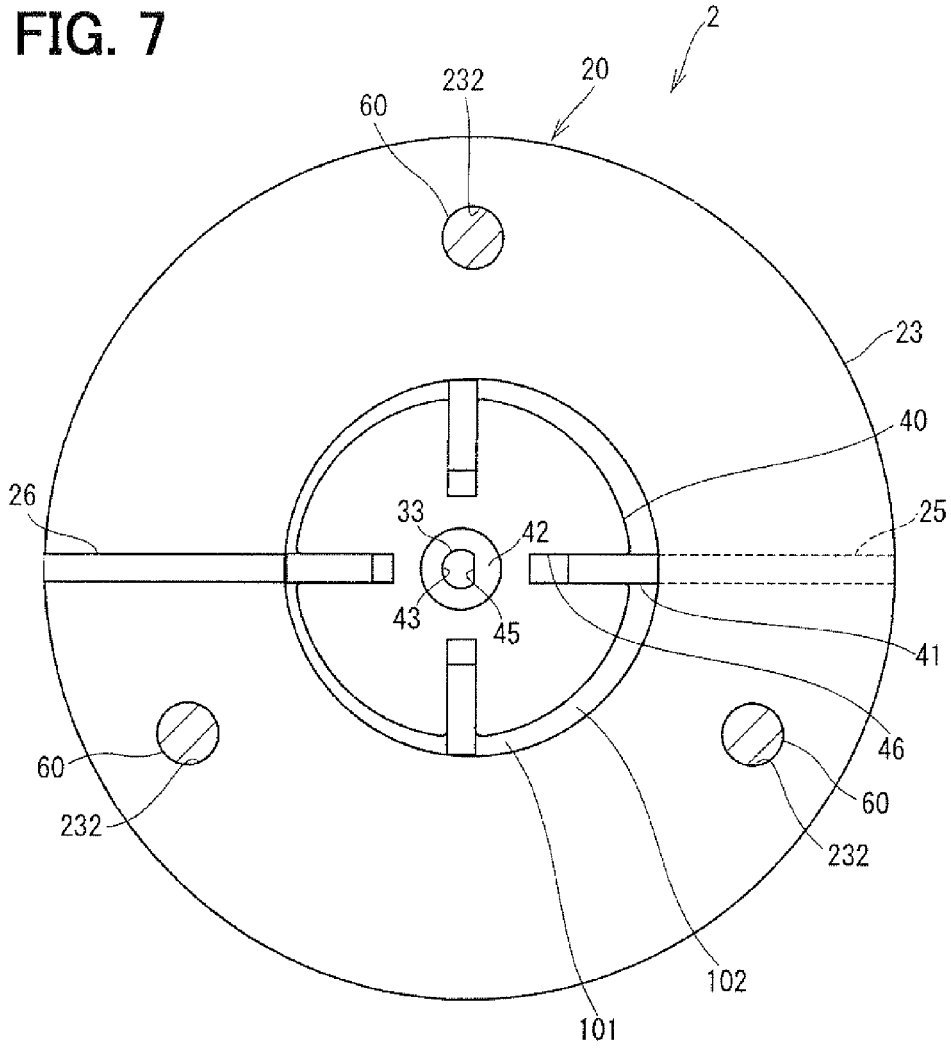
FIG. 7 is a cross-sectional view taken along line VII-VII of FIG. 6.

As shown in FIG. 6, an iron board 37 is arranged on a face of the first board 21 opposite from the cylindrical part 23. A through hole 372 is defined in the iron board 37, a through hole 212 is defined in the first board 21, and a through hole 232 is defined in the cylindrical part 23. A position of the through hole 372, 212, 232 corresponds to that of the through hole 122 of the second board 12. A screw 60 passes through the holes 372, 212, 232, 122, 342, and is mounted to the mount part 34. The iron board 37, the first board 21, the cylindrical part 23, the second board 12, and the elastic sheet 50 are interposed between the head 61 of the screw 60 and the mount part 34, and are tightened to the mount part 34. That is, the housing 20 is fixed and tightened between the iron board 37 and the mount part 34 by the screw 60. A reaction force is generated from the elastic sheet 50, so that the second board 12 receives a face pressure from the elastic sheet 50 toward the cylindrical part 23. As a result, air-tightness or liquid-tightness of the pump chamber 101 can be kept, because the pump chamber 101 is surrounded by the first board 21, the cylindrical part 23 and the second board 12.

The pump chamber 101 accommodates the rotor 40, and the rotor 40 is rotatable in the pump chamber 101. As shown in FIG. 7, a space 102 is defined between the cylindrical part 23 and the rotor 40, and is surrounded by the first board 21 and the second board 12 in the axis direction. The rotor 40 is located eccentric to an axis of the cylindrical part 23, so that a volume of the space 102 defined between the cylindrical part 23 and the rotor 40 is varied in a circumference direction of the cylindrical part 23.

The space 102 is connected to outside through an inlet port 25, a first outlet port 26, and a second outlet port 27 of the housing 20. The port 25, 26, 27 extends outward in the radial direction from the space 102. As shown in FIG. 6, the inlet port 25 is defined on an imaginary plane α that bisects the pump chamber 101 in the axis direction. The inlet port 25 is defined in a manner that a first inlet port and a second inlet port are overlap with each other on the imaginary plane α, so that the inlet port 25 corresponds to the first inlet port and the second inlet port.

The first outlet port 26 and the second outlet port 27 are located to be symmetrical with each other with respect to the imaginary plane α. The first outlet port 26 is defined on an upper end of the cylindrical part 23 in the axis direction, and the second outlet port 27 is defined on a lower end of the cylindrical part 23 in the axis direction. The first outlet port 26 is defined to contact the first board 21, and the second outlet port 27 is defined to contact the second board 12.

According to the second embodiment, the first outlet port 26 and the second outlet port 27 are located symmetrical to each other with respect to the imaginary plane α. Therefore, a pressure difference can be prevented from being generated between the upper end and the lower end of the pump chamber 101 in the axis direction the cylindrical part 23, so that the posture of the rotor 40 can be restricted from being affected. Accordingly, the pumping property can be maintained stable.

Moreover, the first outlet port 26 is defined to contact the first board 21, and the second outlet port 27 is defined to contact the second board 12. Therefore, if wear powder is generated when the rotor 40 slides on the first board 21 and the second board 12, or if wear powder is generated when the vane 41 slides on the cylindrical part 23, the wear powder can be easily discharged out of the pump chamber 101.

The first board 21 and the second board 12 are members independent from each other. Therefore, each of the boards 21, 12 can be solely processed, so that a processing for making the surface flat can be easily performed relative to each of the boards 21, 12.

(Third Embodiment)

A third embodiment will be described with reference to FIG. 8. In a third embodiment, a housing 10 of a vane pump 3 has an outlet port 36 that is different from the outlet port 16, 17 of the first embodiment. Other construction of the vane pump 3 is similar to that of the vane pump 1 of the first embodiment, so that detailed description of the similar part is omitted.

Figure 8:
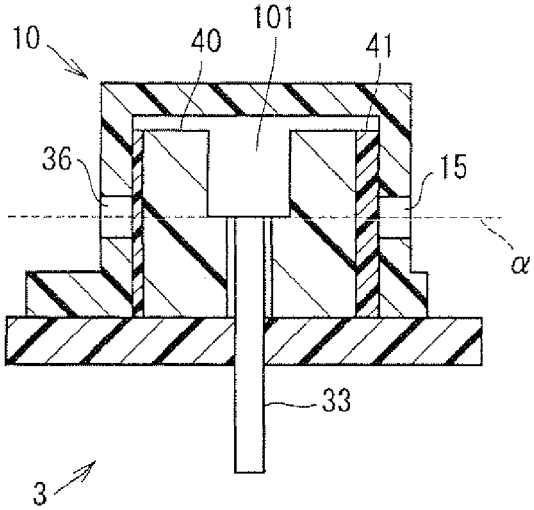
FIG. 8 is a schematic cross-sectional view illustrating a vane pump according to a third embodiment.

As shown in FIG. 8, the outlet port 36 is defined on the imaginary plane α. The outlet port 36 is defined in a manner that a first outlet port and a second outlet port are overlap with each other on the imaginary plane α, so that the outlet port 36 corresponds to the first outlet port and the second outlet port.

According to the third embodiment, the inlet port 15 and the outlet port 36 are defined on the imaginary plane α. Therefore, a pressure difference can be prevented from being generated between the upper end and the lower end of the pump chamber 101 in the axis direction, so that the posture of the rotor 40 can be restricted from being affected. Accordingly, the pumping property can be maintained stable.

(Fourth Embodiment)

A fourth embodiment will be described with reference to FIG. 9. In a fourth embodiment, a housing 10 of a vane pump 4 has a first inlet port 47 and a second inlet port 48 that are different from the inlet port 15 of the first embodiment. Other construction of the vane pump 4 is similar to that of the vane pump 1 of the first embodiment, so that detailed description of the similar part is omitted.

Figure 9:
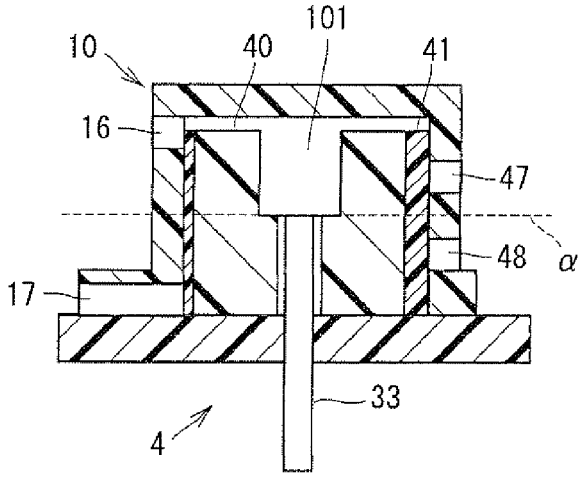
FIG. 9 is a schematic cross-sectional view illustrating a vane pump according to a fourth embodiment.

As shown in FIG. 9, the inlet port 47, 48 are located symmetrical with each other with respect to the imaginary plane α. A distance defined between the first inlet port 47 and the imaginary plane α is equal to that defined between the second inlet port 48 and the imaginary plane α in the axis direction.

According to the fourth embodiment, a pressure difference can be prevented from being generated between the upper end and the lower end of the pump chamber 101 in the axis direction, so that the posture of the rotor 40 can be restricted from being affected. Accordingly, the pumping property can be maintained stable.

(Fifth Embodiment)

A fifth embodiment will be described with reference to FIG. 10. In a fifth embodiment, a housing 10 of a vane pump 5 has a first inlet port 47, a second inlet port 48 and an outlet port 36 that are different from the ports 15, 16, 17 of the first embodiment. Other construction of the vane pump 5 is similar to that of the vane pump 1 of the first embodiment, so that detailed description of the similar part is omitted.

Figure 10:
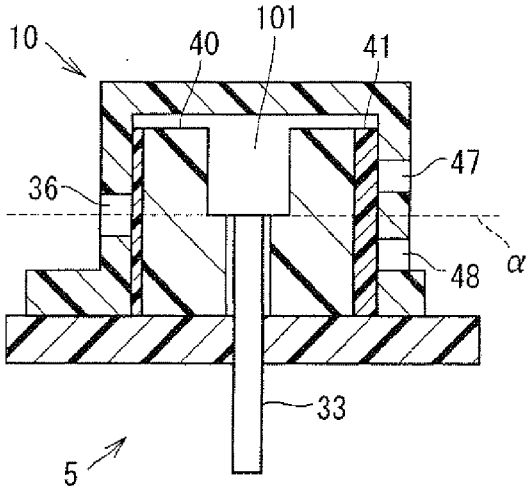
FIG. 10 is a schematic cross-sectional view illustrating a vane pump according to a fifth embodiment.

As shown in FIG. 10, the inlet ports 47, 48 are located symmetrical with each other with respect to the imaginary plane α, and the outlet port 36 is located on the imaginary plane α.

According to the fifth embodiment, a pressure difference can be prevented from being generated between the upper end and the lower end of the pump chamber 101 in the axis direction, so that the posture of the rotor 40 can be restricted from being affected. Accordingly, the pumping property can be maintained stable.

(Other Embodiment)

The first inlet port and the second inlet port are located symmetrical with each other through a predetermined interval with respect to the imaginary plane α. The predetermined interval is not limited to the above example.

The first outlet port and the second outlet port are located symmetrical with each other through a predetermined interval with respect to the imaginary plane α. The predetermined interval is not limited to the above example.

The vane pump is not limited to be arranged in a manner that the axis of the cylindrical part is coincident with the gravity direction.

The check system may check a leakage of vapor fuel by compressing an inside of the fuel tank. The vane pump may be applied to other know device that decompresses or compresses fluid.

Such changes and modifications are to be understood as being within the scope of the present invention as defined by the appended claims.

What is claimed is:

1. A vane pump comprising:

a housing including a cylindrical part, a first board closing an end of the cylindrical part in an axis direction, and a second board closing the other end of the cylindrical part in the axis direction, wherein a pump chamber is defined among the cylindrical part, the first board and the second board;

a rotor having an approximately column shape rotatably arranged in the pump chamber, the rotor having a center hole passing through the rotor in the axis direction at an approximately center position, and a plurality of vanes slidable on an inner wall of the housing; and a motor having a shaft fitted into the center hole of the rotor, the motor rotating the rotor by rotating the shaft, wherein an imaginary plane is defined to bisect the pump chamber in the axis direction, the housing has a first inlet port and a second inlet port located symmetrical with each other with respect to the imaginary plane, the housing has a first outlet port and a second outlet port located symmetrical with each other with respect to the imaginary plane, the first outlet port is located at the end of the cylindrical part in the axial direction, and extends in a radial direction of the cylindrical part, and the second outlet port is located at the other end of the cylindrical part in the axial direction and extends in the radial direction of the cylindrical part.

2. The vane pump according to claim 1, wherein the first inlet port and the second inlet port are overlap with each other on the imaginary plane.

3. The vane pump according to claim 1, wherein at least one of the first outlet port and the second outlet port is located on a lower side of the cylindrical part in a gravity direction.

4. The vane pump according to claim 1, wherein at least one of the first board and the second board is integrated with the cylindrical part.

5. A vapor leakage check system to detect a leakage of fuel vapor from a fuel tank, the vapor leakage check system comprising the vane pump according to claim 1, a pressure sensor to detect a pressure in the fuel tank, and an electronic control unit, wherein the electronic control unit detects the leakage of fuel vapor by comparing the pressure detected by the pressure sensor with a predetermined threshold pressure when an inside of the fuel tank is decompressed or compressed by driving the vane pump.

6. The vane pump according to claim 1, wherein each of the first inlet port and the second inlet port extends in the radial direction of the cylindrical part.

7. The vane pump according to claim 1, wherein the first outlet port is positioned at the end of the cylindrical part directly under the first board in the axis direction, and the second outlet port is positioned at the other end of the cylindrical part directly above the second board in the axis direction.

8. The vane pump according to claim 1, wherein all of the first inlet port, the second inlet port, the first outlet port and the second outlet port are defined only in the cylindrical part.

* * * * *